US006557278B1

(12) United States Patent
Huang

(10) Patent No.: US 6,557,278 B1
(45) Date of Patent: May 6, 2003

(54) ORNAMENT CARD

(76) Inventor: Kuo-Ying Huang, 8F., No. 322, Wan-Pan Rd., Pan-Chiao 220, Taipei Hsien (TW)

( * ) Notice: Subject to any disclaimer, the term of this patent is extended or adjusted under 35 U.S.C. 154(b) by 0 days.

(21) Appl. No.: 10/106,352

(22) Filed: Mar. 27, 2002

(51) Int. Cl.[7] ..... G09F 1/00
(52) U.S. Cl. ..... 40/124.19; 40/124.01
(58) Field of Search ..... 40/124.19, 124.01, 40/673, 610; 248/225.11, 223.41

(56) References Cited

U.S. PATENT DOCUMENTS 1,395,127 A * 10/1921 Lovett ..... 40/673
2,756,525 A * 7/1956 Greenberger ..... 40/673
4,208,818 A * 6/1980 Butcher ..... 40/610
4,862,617 A * 9/1989 Cooke et al. ..... 40/673

* cited by examiner

*Primary Examiner*—Gary Hoge
(74) *Attorney, Agent, or Firm*—Trowell Law Office PLLC

(57) ABSTRACT

An ornament card which is formed into a shape with a punch machine; one side of the card has a guide slot, of which the width is larger than the thickness of the card; a clamp slot having a width equal to the thickness of the card is furnished inside the guide slot; the inner end of the guide slot has a small round hole; a shoulder is furnished between the clamp slot and the guide slot; two cards can be connected together by means of the elongate guide slots; the clamp slots are used for fastening the cards in place, while the small round hole can provide a buffer function; after two cards are connected together, they would not separate from each other upon being pushed by a reverse force.

4 Claims, 6 Drawing Sheets

ORNAMENT CARD

BACKGROUND OF THE INVENTION

1. Field of the Invention

This invention relates to a card, and particularly to an ornament card punched into form.

2. Description of the Prior Art

The conventional gift package is usually bundled up with a band as an ornament, and the ends of the band are fastened into a butterfly knot to facilitate the package to untie later. The package may be attached with a card, on which suitable season greetings are written.

SUMMARY OF THE INVENTION

The prime object of the present invention is to provide an ornament card punched into a form; one side of the card is furnished with a guide slot, which includes a clamp slot and a small round hole. The guide slot can have the card attached to a thing smoothly.

Another object of the present invention is to provide an ornament card. In which both sides of the clamp slot have short slot surfaces facilitate the card to attach to a thing or the like.

Still another object of the present invention is to provide an ornament card, in which the clamp slot includes an interval slot that divides the clamp slot into two slot surfaces; each of the two slot surfaces has a short slot surface so as to facilitate an ornament card to attach to a thing firmly by means of the interval slot without separation.

A further object of the present invention is to provide an ornament card, in which the outer end of the shoulder between the guide slot and the clamp slot is furnished with symmetrical slots, which facilitate the card to attach to a large thing, such as a thick string or the like.

A still further object of the present invention is to provide an ornament card, in which a shoulder clamp slot is furnished between the guide slot and the shoulder of the clamp slot; both sides of the guide slot have two cylindrical slots respectively and symmetrically, which can facilitate the ornament card to turn and to fasten in place upon the card being attached to a thing.

Yet another object of the present invention is to provide an ornament card, which is formed into a rectangular shape with suitable patterns, which can be varied upon two cards being connected in cross, or being pressed in flat arrangement so as to be used as a toy.

DETAILED DESCRIPTION OF THE PREFERRED EMBODIMENT

Figure 1:
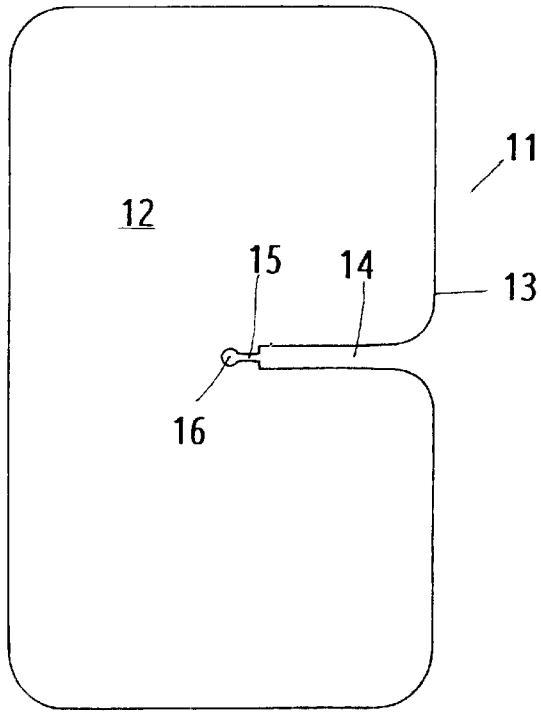
FIG. 1 is a plan view of the present invention, showing the shape of the ornament card.
Figure 2:
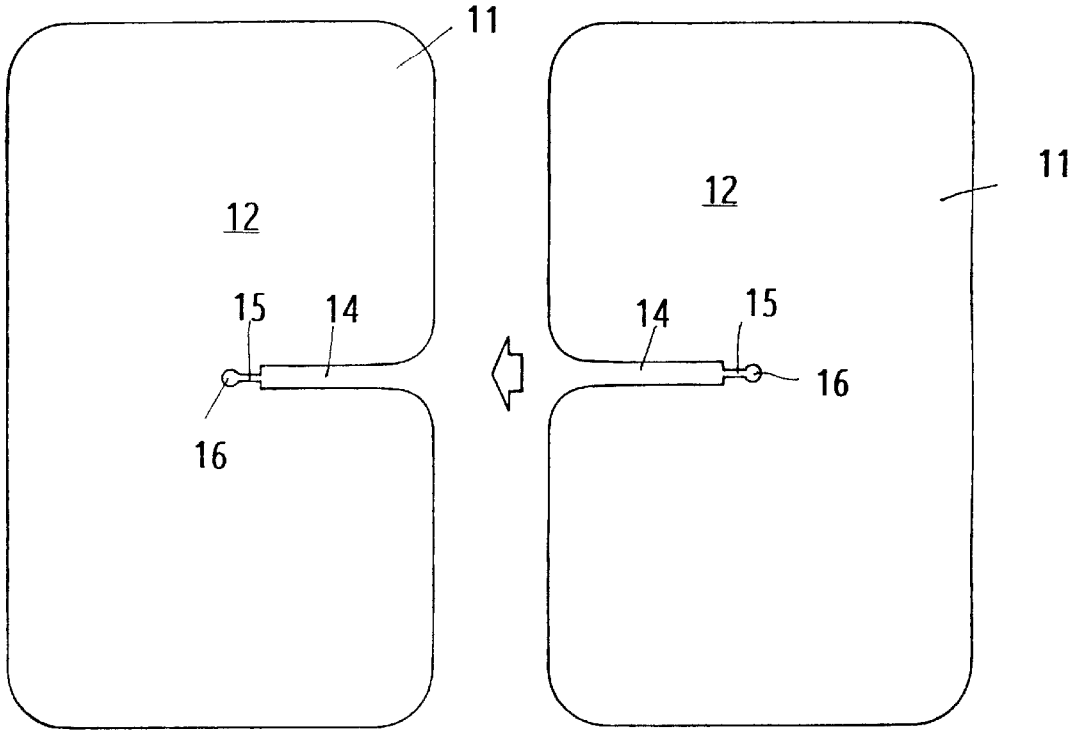
FIG. 2 is a plan view of the present invention, showing two ornament cards being connected in cross.
Figure 3:
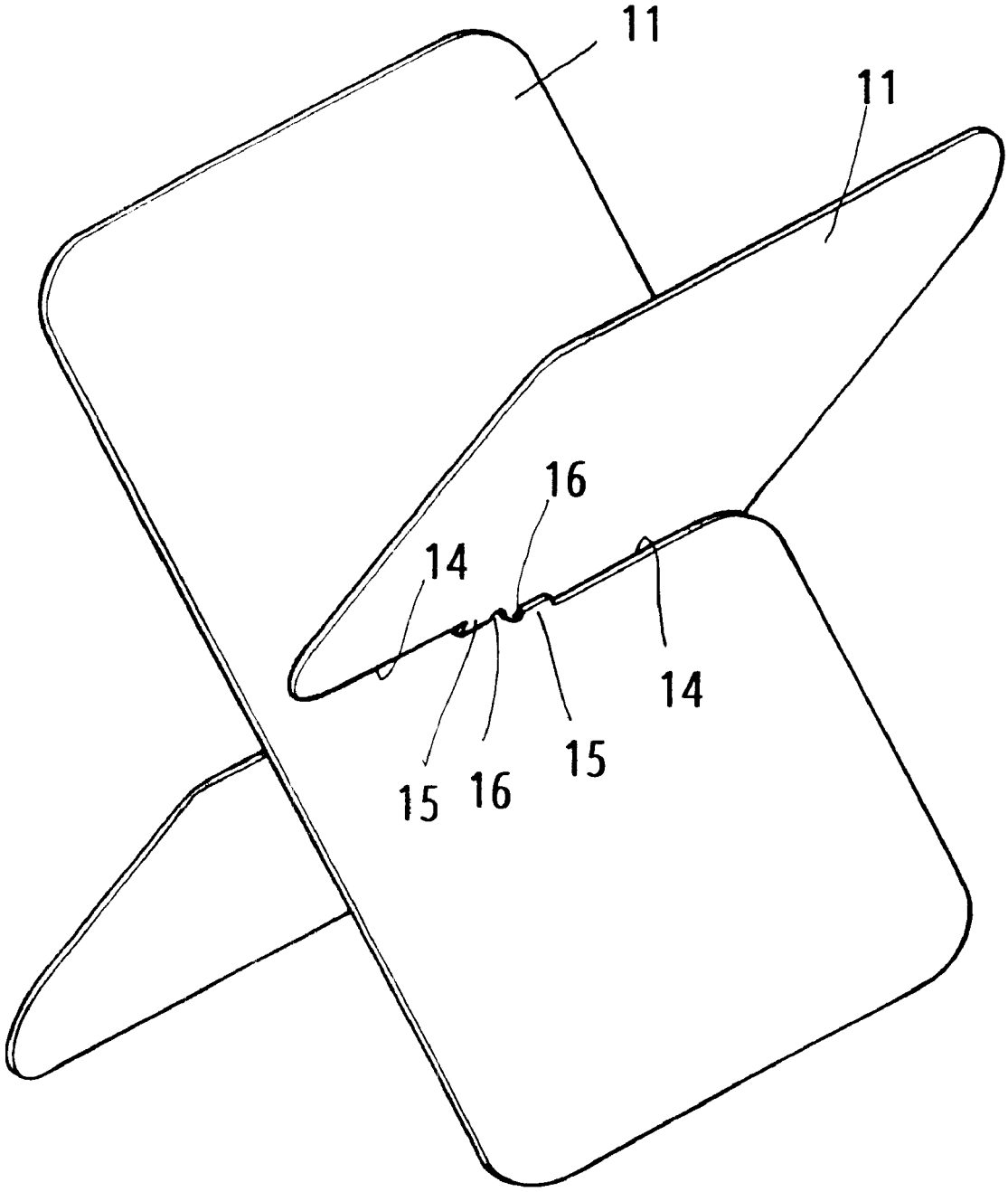
FIG. 3 is a perspective view of the present invention, showing two ornament cards connected in cross.
Figure 4:
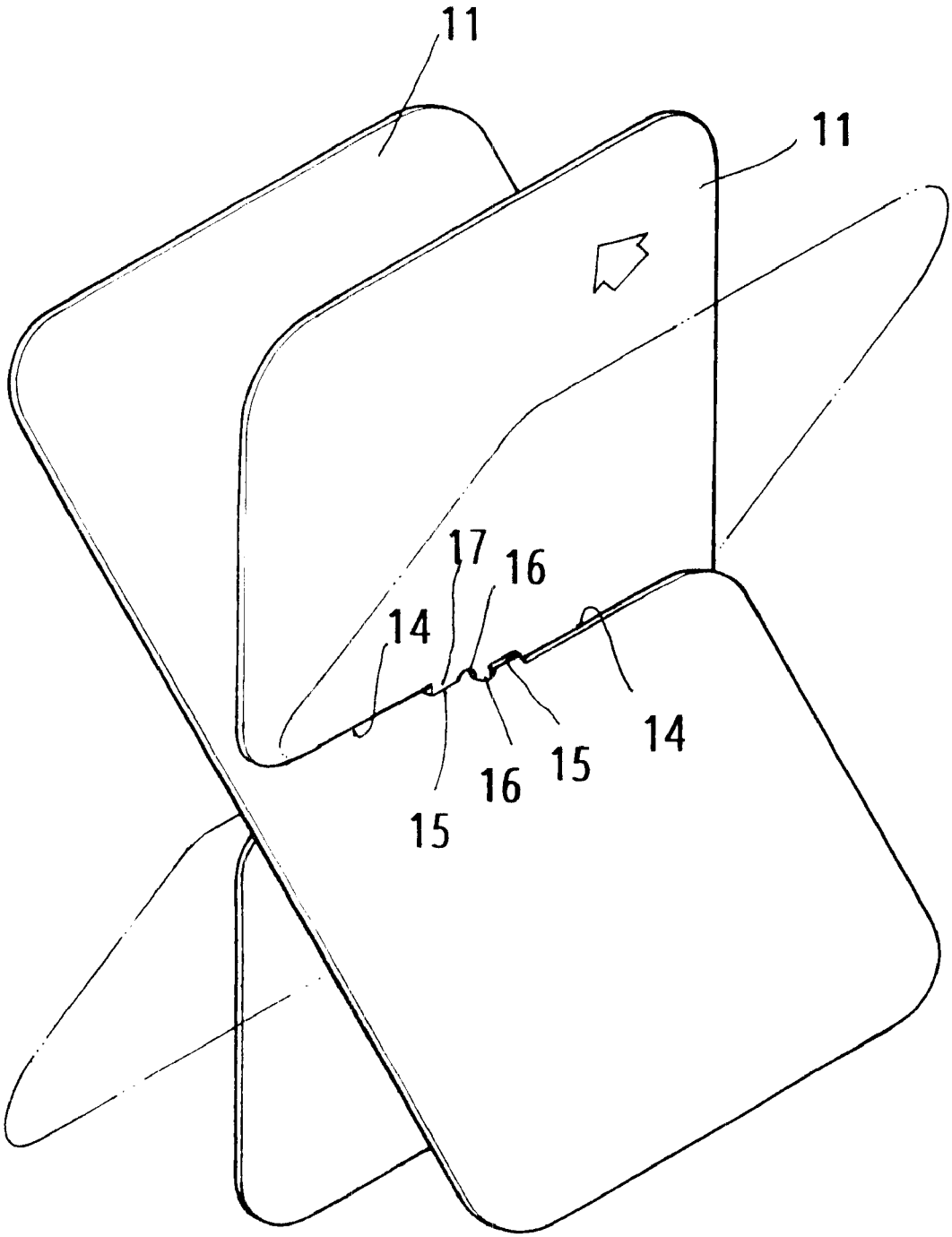
FIG. 4 is a perspective view of the present invention, showing two ornament cards connected and turned.

Referring to FIGS. 1 to 7, this invention relates to an ornament card, in which the card is made of a plastic card printed with a suitable pattern; the plastic card is substantially made of PS or PP plastics, or a rigid paper; the thickness of the card is ranging from 0.60–1.00 m/m (millimeter). The card is punched into a form in accordance with the pattern so as to used as an ornament card; a guide slot 14 is furnished at a suitable spot one edge 13 of the card; the guide slot 14 includes a clamp slot 15 and a buffer round hole 16. Between the clamp slot 15 and the guide slot 14, there is a shoulder 20, which includes a shoulder clamp slot 25 or a second guide slot 28. The guide slot 14 on the edge 13 of the card 11 facilitates the card to be connected with something; by means of the clamp slot 15 and the interval slot 19, the ornament card can be fastened to an object so as to provide a mark or ornament function.

As shown in FIGS. 1 to 4, it is a rectangular toy card 11, of which the body portion 12 can be printed with different pattern; the center of the card 11 is punched with a small round hole 16; one side of the round hole 16 facing a wide edge 13 is furnished with a clamp slot 15 and a guide slot 14; the guide slot 14 is an elongate slot, and the width of the clamp slot 15 is equal to the thickness of the card 11. After two cards 11 are connected together in cross, the clamp slots 15 of the two cards will pass through the small round holes 16 each other, i.e., the clamp slot 15 of one card will hold to the opposite card 11 so as to have the two card connected together. After two cards 11 are connected together, the two round holes 16 of the two cards will be connected in series to provide a buffer space; in that case, the ends of clamp slots 15 would not collide with each other so as to prevent damage or bias.

Figures 1, 5:
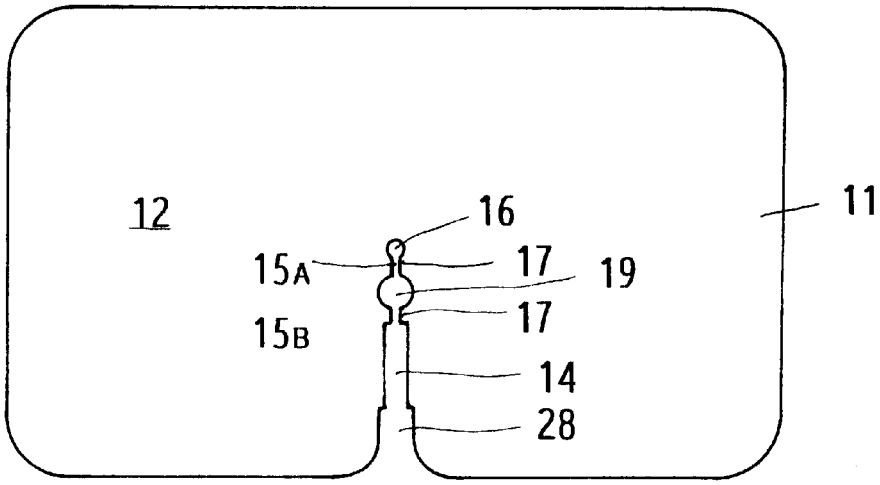
FIG. 5 is the second embodiment of the present invention, showing a rectangular ornament card furnished with fastening slots.
Figures 2, 5:
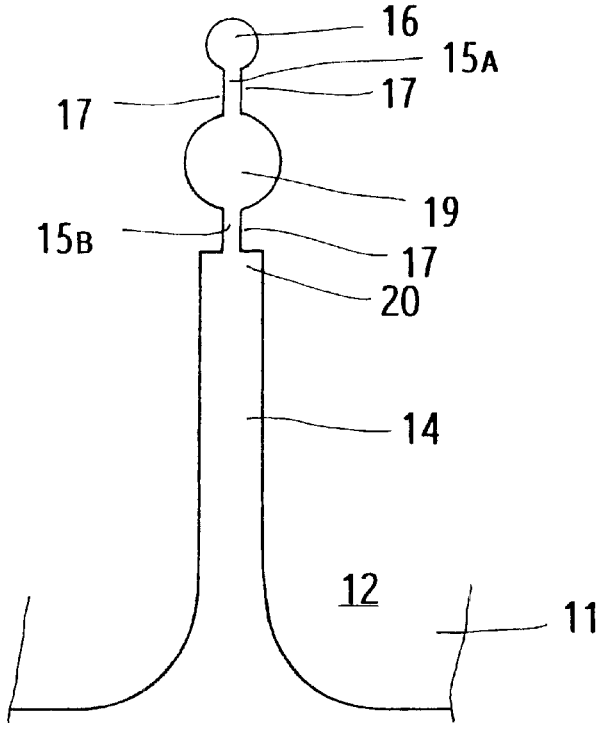
Figures 1, 6:
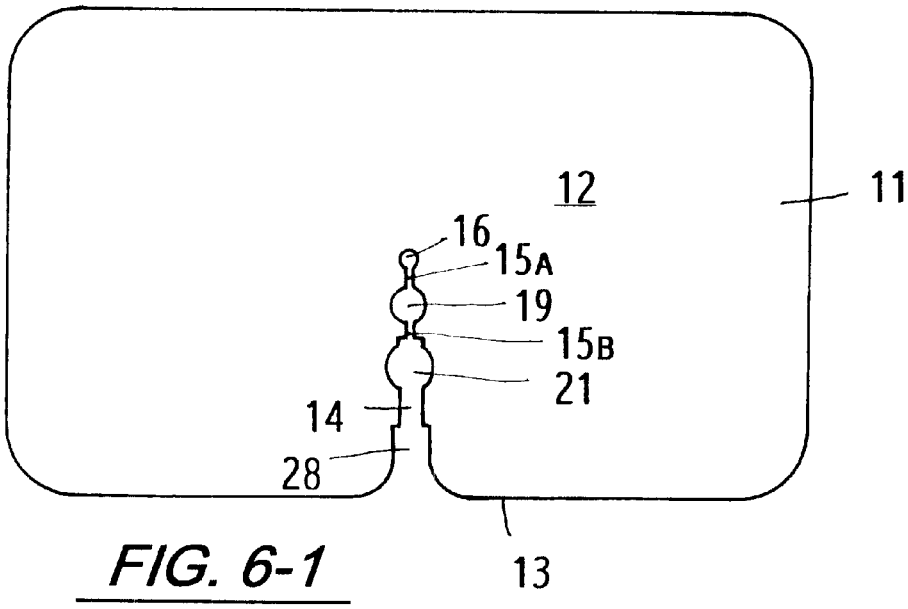
FIG. 6 is the third embodiment of the present invention, showing a rectangular ornament card furnished with fastening slots.
Figures 2, 6:
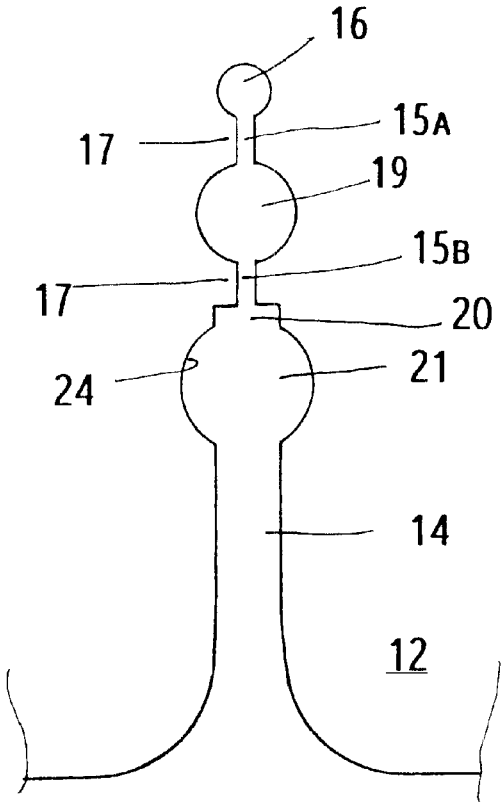

The clamp slot 15 beside the small round hole 16 in the rectangular toy card 11 is used for holding the opposite card 11 upon connecting two cards together; the clamp slot 15 should not be too long to cause the connection of two cards to become loose. If the clamp slot 15 is a long groove as shown in FIGS. 5 and 6, the clamp slot 15 must be furnished with an interval slot 19; in that case, the clamp slots 15 on both sides of the interval slot 19 should have a length as shown in FIGS. 1 to 4.

The outer end of the clamp slot 15 has a wider guide slot 14, of which both sides are in parallel arrangement; a shoulder 20 is furnished between both sides of the guide slot 14 and the clamp slot 15; the shoulder 20 is designed in right-angle shape, or in a curved shape. The shoulder 20 between the guide slot 14 and the clamp slot 15 would not hinder the connection of two rectangular cards 11.

When two rectangular cards 11 are connected together, they are connected in cross and right-angle arrangement; then, the clamp slots 15 of two cards 11 will move into the shoulders 20 in the guide slot 14 and the clamp slots 15 soon. Since the two cards 11 have a clamp force each other, the round holes 16 of two cards 11 will connected in series firmly without loosening by reacting force upon the cards being played by a person.

Two rectangular cards 11 are normally connected and crossed at a right angle; when two cards 11 are pressed in flat form, the patterns of the two cards 11 can be formed into a different corresponding combination. During playing the cards, the cards can be turned continuously to provide four different corresponding combinations. Two rectangular cards 11 may be disassembled, and again assembled in reverse connection so as to provide another four different combinations to obtain more fun for children. After two cross-connected cards are at a right angle, they may be pressed into almost a flat form; in that case, the small round hole 16 in the clamp slot 15 and the shoulder 20 will become a resilient clamp piece 17, which has a lower height to provide an excellent resilience. When two cards are pressed into a flat form, the clamp pieces 17 would not be at an opposite position exactly so as to provide a restoring resilience therefor. The two connected cards 11 have four printed patterns, and as soon as they are pressed into a flat form, the adjacent patterns of the two cards 11 can provide different combination for children who play the cards.

The ornament card 11 with guide slot 14, clamp slot 15 and a round hole 16 may, in addition to providing fun, be used for daily life design by changing the outer shape; for example, the form of the guide slot 14 and the clamp slot 15 may by changed, as shown in FIG. 5, i.e., the clamp slot 15 can be designed into two slots 15A and 15B; an interval slot 19 is furnished between the slot 15A and slot 15B, and the diameter thereof is larger than that of the small round hole 16; consequently, a cascade of round holes is formed inside the guide slot 14. When the card is used as a tag for garment, the shape thereof may be designed according to the requirement; for instance, the guide slot 14 may be attached to a button of the garment, and then the bottom threads may enter the interval slot 19 and the small round hole 16; when the button threads enter the interval slot 19, the threads are flexible; when the threads enter the small round hole 16, the threads will be limited in a given space. The slot and the round hole can provide different fastening tightness so as to facilitate selection of using a string or a thread. After the guide slot 14 is mounted on a button, the small clamp slots 15A and 15B can hold the ornament card in place without dropping unintentionally.

Between the cascade round holes inside the guide slot 14, there are two clamp slots 15A and 15B, which are used for attaching an ornament card to a thread or string as a tag of garment. The thread or string is usually used for fastening a gift or the like, and the guide slot 14 of an ornament card can easily be attached thereto. As shown in FIG. 6, a retaining slot 21 is furnished nearing the shoulder 20 of the guide slot 14 so as to provide a cascade of round holes with different diameter in the guide slot 14 to facilitate a card to attach to a string. After a card is fastened in place, the retaining slot 21 would hold the string from separation; then, the ornament card can be used as a tag of a gift packed up.

Figures 1, 7:
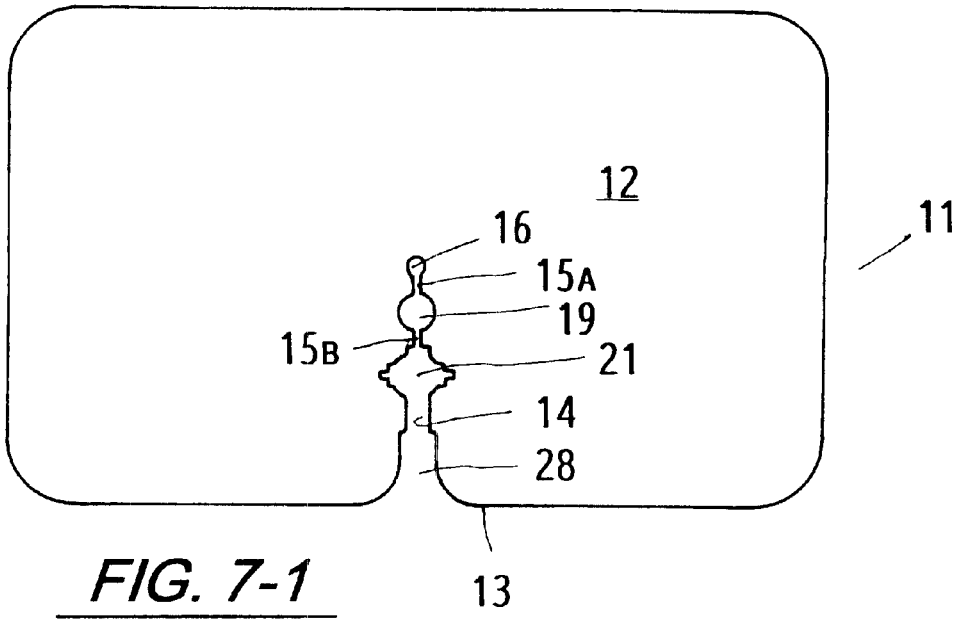
FIG. 7 is the fourth embodiment of the present invention, showing a rectangular ornament card furnished with fastening slots.
Figures 2, 7:
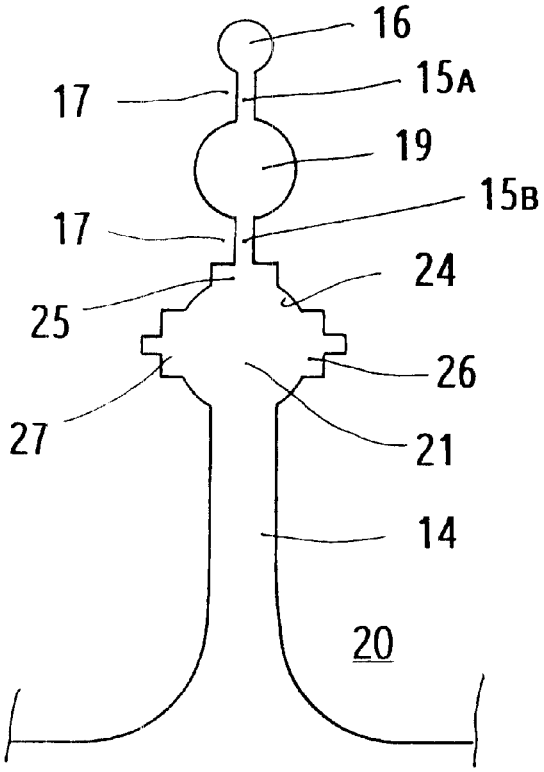

Referring to FIG. 7, the retaining slot 21 in the guide slot 14 is a round hole with a cylindrical slot 24; a shoulder clamp slot 25 is formed between the cylindrical slot 24 and the shoulder 20 so as to facilitate a flat string rolled to mount therein; in order to have a card mounted in place firmly upon the card being turned in different direction, the cylindrical slot 24 of the retaining slot 21 is furnished with two slot surfaces 26 and 27 which are similar to the shape of the shoulder clamp slot 25 to facilitate a string to fasten therein.

The card according to the present invention is formed into an ornament by means of a punch machine, and one side of card has a guide slot 14, which includes a slot and several holes for mounting on a string; the holes are arranged in a cascade shape; one of the holes is furnished with slots for holding a string; the ornament card can be attached to the string of a package through the guide slot 14. The card may be printed with a ornament or a short message, and the card can be attached to the string firmly without separation un-intentionally.

In accordance with the aforesaid description of the embodiments, the features and the structure of the present invention have been disclosed completely, and it is apparent that the present invention has provided obvious improvement of the kind; such improvement is never anticipated and accomplished by any person in the field; therefore, the structure of the present invention is deemed unique.

What is claimed is:

1. An ornament card made of plastic and having an edge shape, and comprising:

a center of one side of said card furnished with an elongate guide slot which includes a clamp slot and a small round hole on one end of said clamp slot; a width of said clamp slot being equal to or slightly smaller than that of said card; a shoulder furnished between said clamp slot and said guide slot; whereby two of said cards are able to be connected together by means of said corresponding slot and holes thereof so as to provide a fastening and buffer function.

2. An ornament card made of plastic and having an edge shape and comprising:

a center of one side of said card furnished with an elongate guide slot which includes a clamp slot and a small round hole on one end of said clamp slot; a width of said clamp slot being equal to or slightly smaller than a thickness of said card; a center of said clamp slot furnished with an interval slot larger than said small round hole so as to divide said clamp slot into two portions; a shoulder furnished between said clamp slot and said guide slot; said elongate guide slot to be mounted on a thread or a string of a package with holes of different diameters so as to facilitate a string mounted in said round hole and said slot without separation.

3. An ornament card as claimed in claim 2, wherein both sides of said shoulder in said guide slot are furnished with symmetrical cylindrical slot portions, of which a diameter being larger than that of round holes in said two clamp slots.

4. An ornament card as claimed in claim 2, wherein a shoulder clamp slot is furnished between outer edge formed with said guide slot and said clamp slot and two curved slots; center of said cylindrical slot on both sides of said guide slot furnished with extended slot.

* * * * *